US005513149A

United States Patent [19]

Salmi et al.

[11] Patent Number: 5,513,149

[45] Date of Patent: Apr. 30, 1996

[54] SOUND DAMPING ARRANGEMENT

[75] Inventors: Pekka Salmi, Vantaa; Jonas Packalén, Kalkstrand; Antti Järvi, Espoo, all of Finland

[73] Assignee: Kvaerner Masa-Yards OY, Helsinki, Finland

[21] Appl. No.: 334,263

[22] Filed: Nov. 3, 1994

[30] Foreign Application Priority Data

Nov. 22, 1993 [FI] Finland ..... 935186

[51] Int. Cl.[6] ..... H04K 3/00

[52] U.S. Cl. ..... 367/1; 114/270

[58] Field of Search ..... 367/1; 114/270

[56] References Cited

U.S. PATENT DOCUMENTS

| | | | |
|---|---|---|---|
| 1,348,828 | 8/1920 | Fessenden | 181/0.5 |
| 3,084,651 | 4/1963 | Parmenter | 114/0.5 |
| 4,135,469 | 1/1979 | Rimppi et al. | 114/270 |
| 4,979,917 | 12/1990 | Haynes | 440/38 |
| 5,036,781 | 8/1991 | Järvi | 114/40 |
| 5,074,813 | 12/1991 | Jarvi et al. | 440/66 |

FOREIGN PATENT DOCUMENTS

| | | |
|---|---|---|
| 1001/74 | 6/1974 | Finland . |
| 2682515 | 4/1993 | France . |
| 1567985 | 5/1980 | United Kingdom . |
| 2149505 | 6/1985 | United Kingdom . |

OTHER PUBLICATIONS

*Red Storm Rising,* Tom Clancy, Berkley Books, 1986, p. 182.

Patent Abstracts of Japan, vol. 11, No. 64(M–565) Feb. 26, 1987 and JP 61 220 997 (Mitsui Eng. & Shipbuilding Co.) Oct. 1, 1986 (English abstract).

*Primary Examiner*—J. Woodrow Eldred

*Attorney, Agent, or Firm*—Smith-Hill and Bedell

[57] ABSTRACT

Underwater sound from a marine vessel driven by one or more propellers is damped by introducing air and/or other gas into the vessel's propeller flow(s) so that the turbulence of the propeller flow(s) causes mixing of the air/gas and water and disintegration of gas bubbles. The majority of the gas bubbles formed in the water are from 1 to 20 mm in diameter.

24 Claims, 3 Drawing Sheets

SOUND DAMPING ARRANGEMENT

BACKGROUND OF THE INVENTION

This invention relates to a method for damping underwater sound caused by a marine vessel and to a marine vessel equipped with apparatus to damp underwater sound.

When carrying out seismic measurements at sea, floating acoustic measuring devices are towed by a marine vessel. However, the noise caused by the towing vessel may badly disturb the function of the measuring devices. To avoid this, it is necessary to take action either to damp the noise caused by the vessel towing the measuring devices or to divert the noise to the sides, so that it cannot disturb the measurement operation.

It is known from U.S. Pat. No. 3,084,651 to use a water bubble zone to damp sound spreading in water and/or to change its propagation direction. In this prior art specification it is stated that earlier attempts to use an air bubble zone for the above mentioned purpose have failed because the air bubbles formed have been too large and have joined together to form still larger bubbles, which too rapidly rise to the water surface. According to the teachings of U.S. Pat. No. 3,084,651, air should be mixed into a liquid flow in a pipe, so that a water/air mixture is formed which can be injected into the water surrounding the vessel. However, this method is difficult to apply, because it requires water and air mixing tubes to be provided externally of the vessel.

The object of the present invention is to solve, in a more simple manner, the problems related to the forming of an air or gas bubble zone, so that bubbles of suitable size as well as a bubble zone of a suitable shape is achieved without complicated accessories.

SUMMARY OF THE INVENTION

By introducing air or other gas into the water in a vessel's propeller flow, of which the turbulence, the flow speed, and the flow rate are precisely known in different operating situations, an easily controllable process is achieved, in which the turbulence of the propeller flow is utilized for disintegrating formed gas bubbles into small bubbles and for mixing them effectively with the water. Thus, the number and the size of the bubbles can easily be adjusted as required.

To achieve an effective sound damping, it is important that a great number of bubbles be formed in the water with a diameter of from 1 to 20 mm. Such small bubbles do not rise quickly to the water surface but stay suspended in the water within a relatively large zone, typically extending up to 100 m or more from the vessel. From the point of view of effective sound damping, the bubble zone should also preferably include a sufficient amount of significantly larger bubbles having a diameter of about 100 mm. Such large bubbles are produced by introducing gas (air and/or other gas) into the water through large nozzles either at the edge zone of the propeller flow or at a region outside the propeller flow.

Adjusting the amount of air or other gas blown into the water to a suitable value is most conveniently carried out by relating it to the water flow rate of the propeller. Because characteristics of the propeller, such as its diameter, its pitch and the number of revolutions in various situations, are known, the water flow rate of the propeller can easily be calculated. In a preferred embodiment of the invention, air or other gas is introduced into the water so that the amount of gas is from 0.05 to 1.5 percent, preferably from 0.1 to 1 percent, of the water flow rate of the propeller. The air or gas volume is in this context calculated at standard temperature and pressure, that is, at normal atmospheric pressure and at a temperature of 0° C.

Most of the noise produced by a marine vessel is at a frequency in the order of magnitude of 100 Hz. A bubble damps sound in water if the frequency of the sound is close to the resonance frequency of the bubble. The resonance frequency of gas bubbles formed in water is dependent on the size of the bubbles. Large bubbles have lower resonance frequencies than smaller bubbles. Gas bubbles with a diameter of at least about 100 mm are needed for damping noise at a frequency of about 100 Hz. Therefore, the size of the formed large bubbles should be adjusted so that their so called resonance size approximately corresponds to the desired damping frequency. A range of bubble sizes is necessary in order to provide effective damping over the range of frequencies present in the noise spectrum of a typical marine vessel. The resonance size of the gas bubbles at different depths can be calculated using known methods. Because the frequency spectrum of the sound generated by a vessel may vary considerably from vessel to vessel, the desired damping frequency may be different from case to case.

Smaller bubbles form a sound propagation obstacle mainly in another manner. The propagation speed of sound in water will change considerably if there is a large number of small bubbles in the water. The propagation direction of the sound changes and the undivided sound wave is broken up in the bubble zone.

The most effective sound damping is achieved by locating the propulsion propeller or propellers of the vessel to the fore end of the vessel and by introducing gas into the water directly behind the or each propeller. This creates a gas bubble zone that surrounds substantially the entire underwater portion of the hull of the vessel, thereby forming a sound damping bubble zone around all the underwater noise sources of the vessel.

The method according to the invention is in practice applied most frequently on vessels having a propulsion power of from about 1,000 kW to about 10,000 kW, but may also be applied on considerably larger vessels, for example on icebreakers when used out of season for seismic surveying, having a propulsion power of more than 10,000 kW. The power required for forming a bubble zone is usually only about from 1 to 7 percent, typically from 2 to 5 percent, of the propulsion power of the vessel.

Small bubbles stay considerably longer in the water than large bubbles. Therefore, it is essential, when applying the invention, that a sufficient amount of such small bubbles is formed in the water, which remain suspended in the water for a relatively long time. A substantial amount of these bubbles should be present in the water at a distance of 80 meters from the vessel. In seismic measurements, the distance to the measuring devices from the towing vessel is usually about 300 m or more.

The size of aperture and the pressure at which gas is injected into the water depend on the air volume required, the aperture depth, the frequency distribution of the noise that is to be damped, and other factors. The gas pressure must exceed the hydrostatic pressure outside the aperture, and the difference between the gas pressure and the hydrostatic pressure determines the volume rate at which the gas is injected into the water. Very high blowing velocities should be avoided, because they produce noise.

Other aspects of the invention relate to a vessel, especially to a towing research vessel, having equipment for applying the method according to the invention and a vessel as such.

BRIEF DESCRIPTION OF THE DRAWINGS

Embodiments of the invention will now be described, by way of example only, with particular reference to the accompanying drawings, in which FIG. 1 schematically shows the application of the method of the present invention to a research vessel towing seismic measuring devices, FIG. 2 schematically shows a front view of the vessel of FIG. 1, FIG. 3 schematically shows a side view of the vessel of FIG. 1, and FIG. 4 schematically shows a side view of the fore end of a towing vessel according to a preferred embodiment.

DETAILED DESCRIPTION

Figure 1:
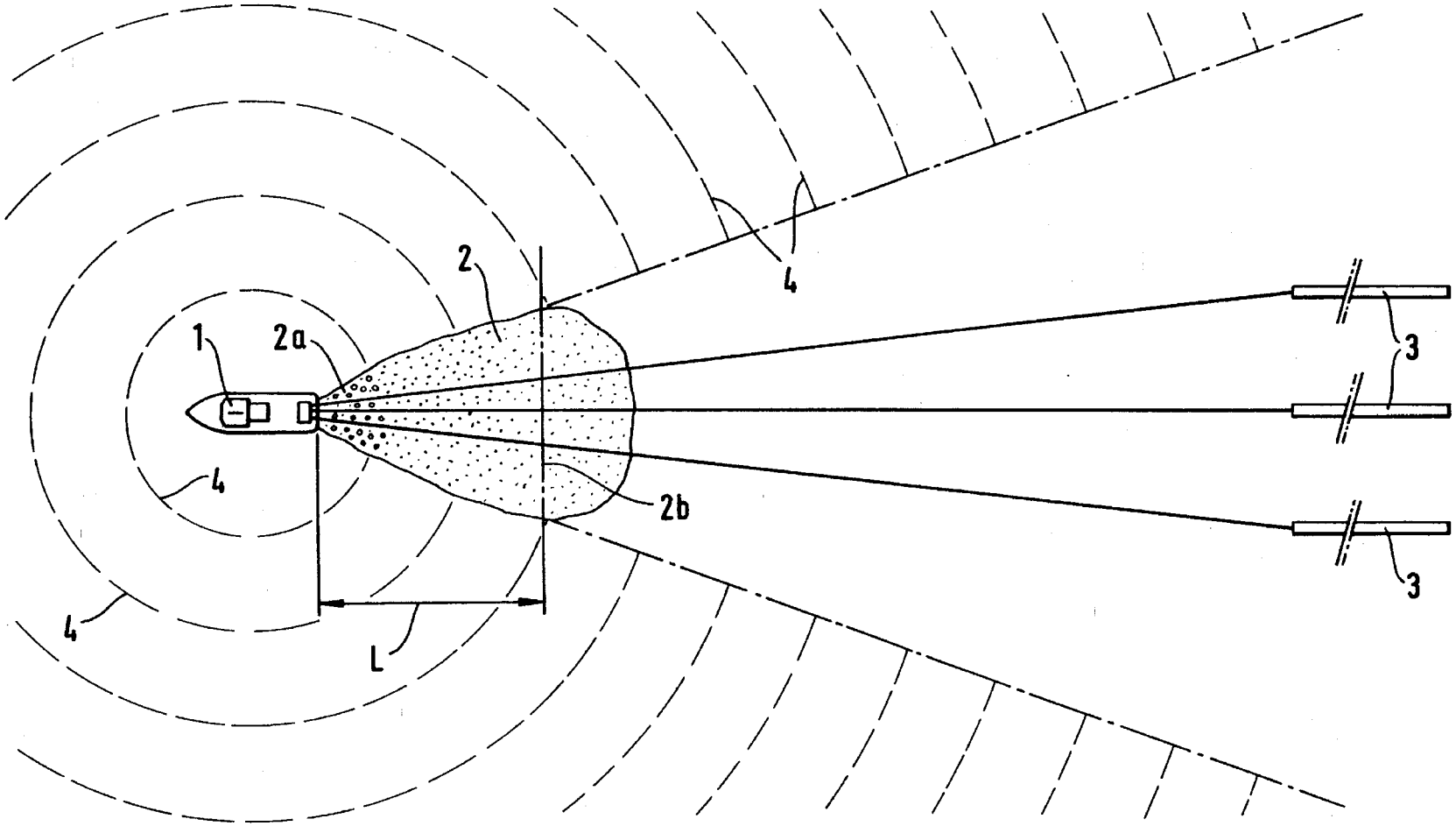
Figure 2:
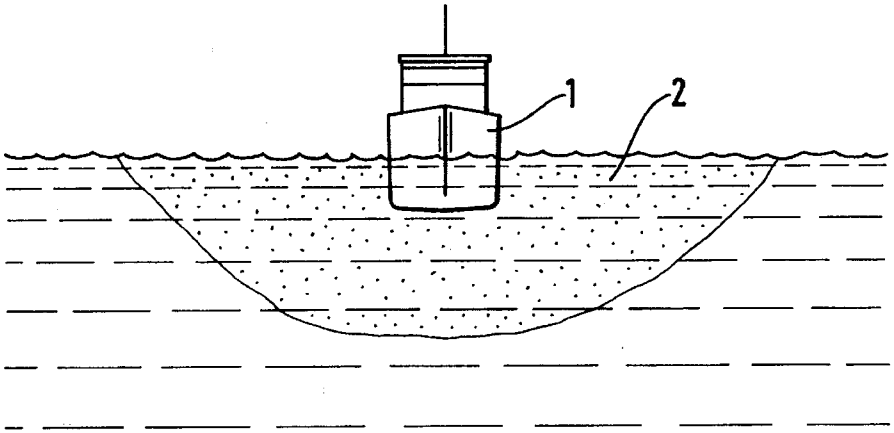
Figure 3:
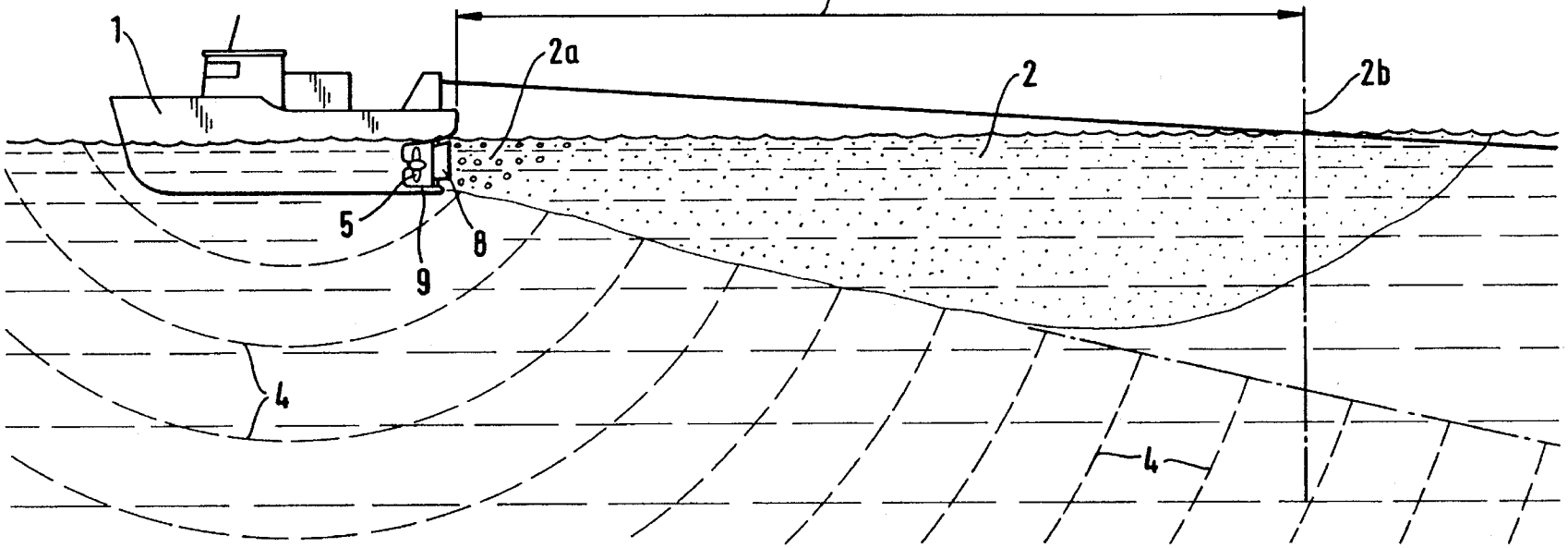

In the drawings, reference numeral 1 indicates a towing research vessel towing a number of seismic measuring devices 3 in open water. The length of the devices 3 may be more than 1000 m and they include acoustic measuring apparatus which must be protected from the sound created by the vessel 1 during movement through the water. To accomplish this, an air bubble zone 2 is formed behind the vessel, which zone partly damps the sound caused by the vessel 1 and partly disintegrates the sound propagating through the water. In FIGS. 1 and 3, sound waves are schematically illustrated by arc line 4.

The vessel has one or more propellers 5, which are driven to rotate by the vessel's engine(s) (not shown). Rotation of the propeller(s) generates propeller flow(s), i.e. water streams, which are directed mainly horizontally and to the rear of the vessel and serve to propel the vessel forwards. The propeller flow(s) are highly turbulent.

A sound wave travels in water at a speed of about 1500 m/s. In a bubble zone with a gas/water mix ratio of about 0.03 percent, the speed of the sound in the water drops to a value of about 500 m/s. If the mix ratio is higher, for example about 0.1 percent, the speed is only about 300 m/s. The slowing down effect of the sound speed by the gas bubble zone causes the propagation direction of the sound wave to change, the propagation direction being changed more the higher or greater the slowing down effect. Further, the bubble zone is not homogeneous, and regions with a high gas/water mix ratio are interspersed with regions with a lower gas water mix ratio. The sound propagation direction therefore changes continuously in an irregular manner. In this manner, the sound is dispersed and scattered and therefore a sound "shade area" is formed behind the bubble zone.

In the case shown in the figures, the bubble zone 2 is formed by blowing air into the water in the propeller flow(s) of the vessel 1, so that the turbulence of the propeller flow(s) breaks or separates the air bubbles and forms a water/air mixture including a large number of small air bubbles having a diameter of from 1 to 20 mm. These small bubbles cause a refraction of the sound waves emanating from the vessel 1, i.e. a change in the direction of propagation of the sound waves. In the bubble zone 2, there should also preferably be a substantial amount of relatively large air bubbles with a diameter of about 100 mm or more. Because these larger bubbles rise quite rapidly to the water surface, they appear mostly in the region 2*a* of the bubble zone closest to the vessel 1.

FIGS. 1 and 3 show a vertical plane 2*b* in the bubble zone 2 at a distance L of 80 m from the propeller(s) 5 of the towing vessel 1. At the defined plane 2*b*, the water should still include a substantial amount of gas bubbles. Because the sound caused by the vessel cannot move through, or is at least substantially prevented from moving through, the gas bubble zone, a sound "shade area" is formed behind the bubble zone. Because of the substantial vertical and horizontal dimensions of the bubble zone, the sound shade area increases in depth and width in a direction away from the towing vessel.

Figure 4:
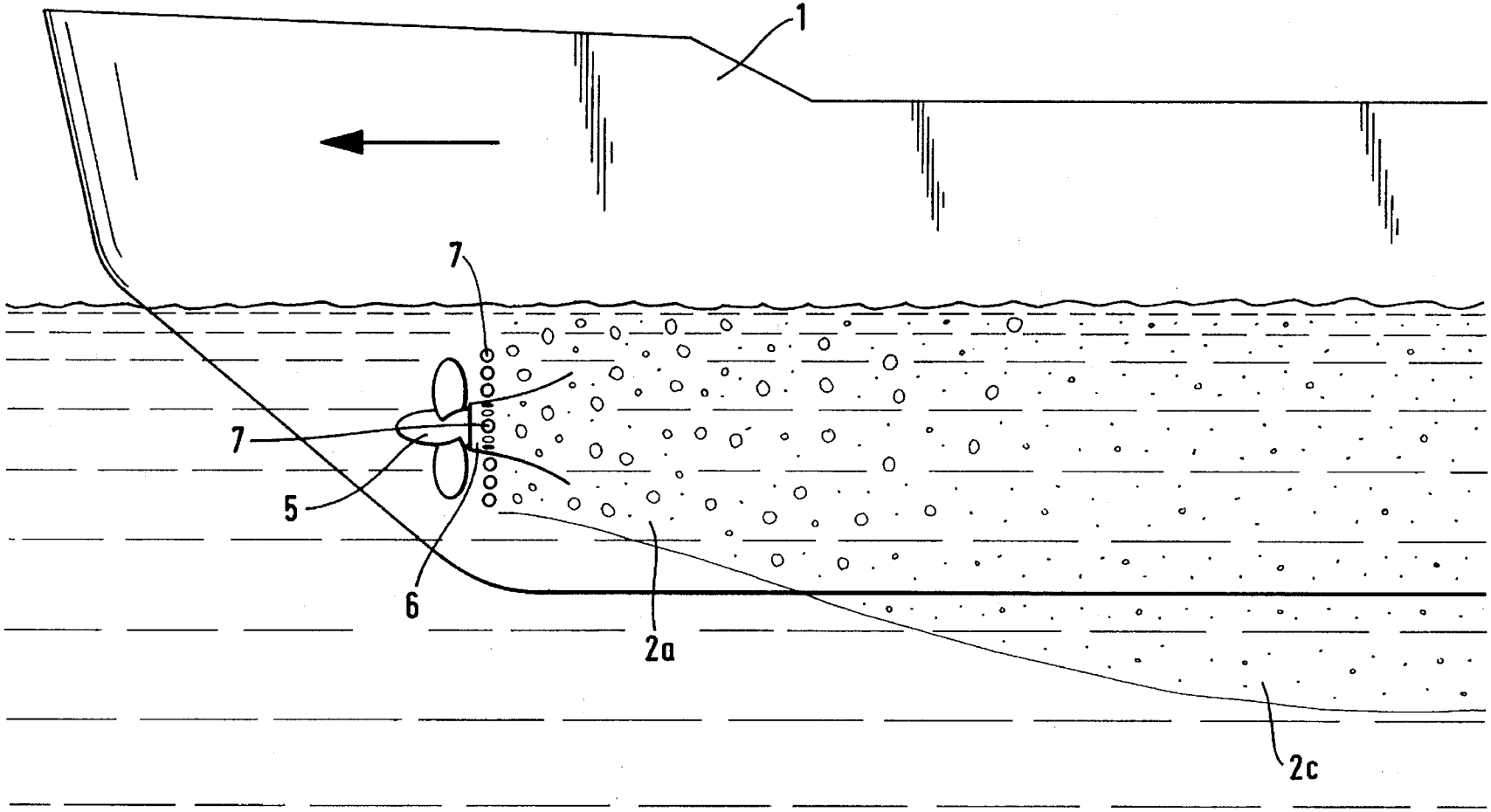

FIG. 4 shows a preferred embodiment of the invention in which the propulsion device of the towing vessel 1 has the form of two propellers 5 at the fore end of the vessel. Only one propeller 5 is visible, the other one being in a corresponding position at the opposite side of the vessel. A number of air blowing apertures 7 are provided in a bearing casing 6 of the propeller shaft and also closely above and below the bearing casing. Through these apertures 7, air pumped into the water comes into the mainly horizontal flows of the propellers 5, which flows mix the bubbles with the water and take them backwards, so that a bubble zone 2*c* is formed which surrounds substantially the whole part of the hull of the vessel 1 which is in the water. In this manner the best sound damping is achieved. The diameter of each of the air blowing apertures 7 is in the order of magnitude of 100 mm. Because some of the apertures 7 are positioned at the border area of the propeller flows produced by the propellers 5, the quite large bubbles, coming through these apertures, are not easily broken up by the propeller flows, so that a substantial amount of larger bubbles remain in the propeller flows.

In the illustrated embodiment, air is introduced into the water at a rate of about 0.5 percent of water flow of the propellers 5. The power used to form the air bubbles is only about 3 percent of the propulsion power of the vessel 1. Instead of forming air bubbles, other gas or a mixture of air and another gas or gases may be used to create the bubble zone.

In the case shown in FIGS. 1 and 3, air and/or other gas can be introduced into the water, for example, through the rudder 8 of the vessel 1 or through its shaft or through a support structure 9 for the lower portion of the rudder under the propeller 5.

The invention is not limited to the embodiments disclosed, but several variations thereof are feasible, including variations which have features equivalent to, but not necessarily literally within the meaning of, features in any of the attached claims. For example, although the invention has particular application to vessels driven by screw propellers , it will be appreciated that the terms "propeller" and "propeller means" used in this description and the claims are intended also to embrace other propeller systems, such as, for example, a Voith-Schneider propeller.

We claim:

1. A method of damping underwater sound emitted by a marine vessel driven by a propeller means that creates at least one turbulent propeller flow in the water, said method comprising introducing gas into the propeller flow in close proximity to the propeller means so that the turbulence of the propeller flow causes a strong mixing of gas and water and formation of gas bubbles in the water behind the vessel as the vessel moves forward and the majority of gas bubbles behind the vessel have a diameter of from 1 to 20 mm.

2. A method according to claim 1, comprising introducing gas into the water at an edge area of the propeller flow so that larger gas bubbles having a diameter considerably in excess of 20 mm are formed in the water and are not disintegrated by turbulence of the propeller flow to have a diameter from 1 to 20 mm.

3. A method according to claim 2, wherein the larger gas bubbles are of diameter in the order of magnitude of 100 mm.

4. A method according to claim 2, wherein the vessel emits sound in a frequency range above a predetermined lower limit and the size of a majority of the larger gas bubbles formed in the water is such that the larger bubbles are of resonance size approximately corresponding to said predetermined lower limit.

5. A method according to claim 1, comprising introducing gas into the water in such a manner that the ratio of volume rate of gas introduced into water relative to water flow volume rate caused by the propeller means is from 0.05 to 1.5 percent.

6. A method according to claim 5, wherein the ratio is from 0.1 to 1 percent.

7. A method according to claim 1, wherein the vessel is a towing vessel and said at least one turbulent propeller flow is created by at least one propeller at the fore end of the vessel, whereby the step of introducing gas into the propeller flow creates a gas bubble zone that surrounds substantially the entire underwater portion of the vessel.

8. A method according to claim 1, wherein power used to form the gas bubbles is from 1 to 7 percent of the propulsion power of the vessel.

9. A method according to claim 8, wherein the power used to form the gas bubbles is from 2 to 5 percent of the propulsion power of the vessel.

10. A method according to claim 1, wherein the size of the gas bubbles is such that behind the vessel a significant amount of gas bubbles exist even at 80 m from the vessel.

11. A method of operating a marine vessel equipped with a propeller means, said method comprising driving the propeller means so that it creates at least one turbulent propeller flow in the water for propelling the vessel in a forward direction, and introducing gas into the propeller flow in close proximity to the propeller means so that the turbulence of the propeller flow causes a strong mixing of gas and water and formation of gas bubbles in the water behind the vessel as the vessel moves in the forward direction and the majority of gas bubbles formed behind the vessel have a diameter of from 1 to 20 mm.

12. A method according to claim 11, comprising introducing gas into the water at an edge area of the propeller flow so that larger gas bubbles having a diameter considerably in excess of 20 mm are formed in the water and are not disintegrated by turbulence of the propeller flow to have a diameter from 1 to 20 mm.

13. A method according to claim 11, comprising introducing gas into the water in such a manner that the ratio of volume rate of gas introduced into the water relative to water flow volume rate caused by the propeller means is from 0.05 to 1.5 percent.

14. A method according to claim 11, wherein the vessel is a towing vessel and said at least one turbulent propeller flow is created by at least one propeller at the fore end of the vessel, whereby the step of introducing gas into the propeller flow creates a gas bubble zone that surrounds substantially the entire underwater portion of the vessel.

15. A method according to claim 11, wherein power used to form the gas bubbles is from 1 to 7 percent of the propulsion power of the vessel.

16. A method according to claim 11, wherein the size of the gas bubbles is such that behind the vessel a significant amount of gas bubbles exist even at 80 m from the vessel.

17. A marine vessel having a propeller means, a drive means for driving the propeller means to create at least one turbulent propeller flow in the water for propelling the vessel in a forward direction, and a gas feed means for introducing gas into the propeller flow in close proximity to the propeller means so that the turbulence of the propeller flow causes a strong mixing of gas and water and formation of gas bubbles in the water behind the vessel as the vessel moves in the forward direction and the majority of gas bubbles formed behind the vessel have a diameter of from 1 to 20 mm.

18. A vessel according to claim 17, further comprising a secondary gas feed means for introducing gas into the water at an edge area of the propeller flow so that larger gas bubbles having a diameter considerably in excess of 20 mm are formed in the water and are not disintegrated by turbulence of the propeller flow to have a diameter from 1 to 20 mm.

19. A vessel according to claim 17, being a towing vessel in which said propeller means comprises at least one propeller at the fore end of the vessel, and wherein the gas feed means is positioned for introducing gas into the water so that a gas bubble zone surrounds substantially the entire underwater portion of the vessel.

20. A method according to claim 1, comprising introducing gas into the water outside the propeller flow so that larger gas bubbles having a diameter considerably in excess of 20 mm are formed in the water and are not disintegrated by turbulence of the propeller flow to have a diameter from 1 to 20 mm.

21. A method according to claim 20, wherein the larger gas bubbles are of diameter in the order of magnitude of 100 mm.

22. A method according to claim 20, wherein the vessel emits sound in a frequency range above a predetermined lower limit and the size of the majority of the larger gas bubbles formed in the water is selected so that the larger bubbles are of resonance size approximately corresponding to said predetermined lower limit.

23. A method according to claim 11, comprising introducing gas into the water outside the propeller flow so that larger gas bubbles having a diameter considerably in excess of 20 mm are formed in the water and are not disintegrated by turbulence of the propeller flow to have a diameter from 1 to 20 mm.

24. A vessel according to claim 17, further comprising a secondary gas feed means for introducing gas into the water outside the propeller flow so that larger gas bubbles having a diameter considerably in excess of 20 mm are formed in the water and are not disintegrated by turbulence of the propeller flow to have a diameter from 1 to 20 mm.

* * * * *